United States Patent [19]

Collishaw et al.

[11] 4,397,754

[45] Aug. 9, 1983

[54] PERSONAL CLEANING PRODUCTS

[75] Inventors: Peter S. Collishaw, Nottingham; Donald Bird, Accrington, both of England

[73] Assignees: Caligen Foam Limited, Accrington; W. E. Saxby (Nottingham) Limited, Nottingham, both of England

[21] Appl. No.: 305,262

[22] Filed: Sep. 24, 1981

[30] Foreign Application Priority Data

Sep. 27, 1980 [GB] United Kingdom ..... 8031296

[51] Int. Cl.[3] ..... C11D 17/04; C11D 17/06

[52] U.S. Cl. ..... 252/91; 252/117; 252/174.21; 252/174.22; 252/134; 252/DIG. 16; 427/242; 428/320.2; 428/321.1; 15/104.93; 15/104.94; 521/905

[58] Field of Search ..... 252/174, 134, 174.13, 252/174.21, 174.22, 91, 117, DIG. 16; 427/242; 428/320.2, 321.1; 15/104.93, 104.94, 227; 521/905

[56] References Cited

U.S. PATENT DOCUMENTS

| | | | |
|---|---|---|---|
| 580,148 | 4/1897 | Staples | 15/227 UX |
| 3,112,219 | 11/1963 | Politzer et al. | 15/104.94 |
| 3,227,614 | 1/1966 | Scheuer | 167/84 |
| 3,305,488 | 2/1967 | Osipow | 252/117 |
| 3,530,030 | 9/1970 | Adam et al. | 15/104.93 |
| 3,595,800 | 7/1971 | Wieczorek | 252/117 |
| 3,663,445 | 5/1972 | Augustin et al. | 252/117 |
| 3,795,624 | 3/1974 | Feinstone | 252/91 |
| 3,944,694 | 3/1976 | McQueary | 252/91 |
| 4,248,928 | 2/1981 | Spadini et al. | 252/91 |

FOREIGN PATENT DOCUMENTS

| | | |
|---|---|---|
| 2460293 | 12/1974 | Fed. Rep. of Germany . |
| 47-29561 | 3/1972 | Japan . |
| 54-43904 | 4/1979 | Japan . |

*Primary Examiner*—John E. Kittle
*Assistant Examiner*—Hoa Van Le
*Attorney, Agent, or Firm*—Alan H. Levine

[57] ABSTRACT

A disposable personal cleaning product comprises a thin substrate, preferably open celled polyurethane foam, from 1–5 mm thick having dispersed throughout its cross-section a detergent composition comprising a non-ionic alcohol ethoxylate and a fatty acid soap, preferably 90–10% by weight of the former and 10–90% by weight of the latter, the ratio of detergent composition to substrate being between 2:1 and 10:1 by weight. The substrate may be provided with slits or similar openings which may be engaged by a user's fingers to enable the product to be maintained in an open or spread condition during use.

26 Claims, 2 Drawing Figures

PERSONAL CLEANING PRODUCTS

Figure 1:
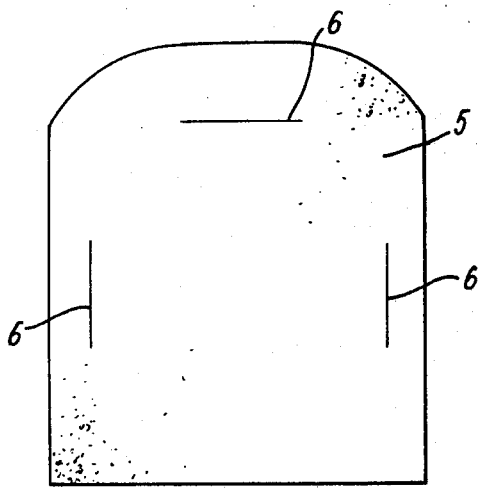

This invention relates to personal cleaning products and is especially but not exclusively applicable to a product for use in showers.

The invention provides a disposable personal cleaning product comprising a substrate consisting of a sheet of open celled foam structure from 1–5 mm thick having dispersed throughout its cross-section a detergent composition comprising a non-ionic alcohol ethoxylate and a fatty acid soap.

Preferably the ratio of detergent composition to substrate is being 2:1 and 10:1 by weight.

The detergent composition preferably comprises 90–10% by weight of a non-ionic alcohol ethoxylate and 10–90% by weight of a fatty acid soap.

Any suitable open celled flexible foam structure may be used as a substrate but polyurethane foams and particularly polyester-urethane foams are preferred due, particularly in the latter case, to the uniform foam structure which assists in uniform impregnation and release of the detergent composition.

The substrate is advantageously provided with slots or other openings which may be engaged by the user's fingers to enable the product to be maintained in an open or spread condition during use.

Thus the invention also provides a personal cleaning product comprising a substrate of thin sheet-like form provided with apertures engageable by a user's fingers to enable the product to be maintained in an open or spread condition during use.

In order to ensure uniform release of the detergent composition it is necessary to ensure that it is dispersed througout the thickness of the cellular substrate. For this purpose it is preferred that the detergent composition should be applied to the substrate in a melted condition while the substrate is compressed, the substrate being subsequently allowed to expand thereby creating a partial vacuum within the cell structure which draws the composition into and disperses it through the structure.

The extent to which the foam is compressed may be varied dependent on the nature and thickness of the foam, the rate of movement of the foam through the impregnating apparatus during treatment and the detergent composition employed, but the degree of compression must be such that on subsequent expansion the detergent composition is drawn into the foam structure such that it is dispersed throughout its cross-section. The foam structure in effect acts as a reservoir for the detergent composition which is subsequently released in a uniformly controlled manner when the product is wetted during showering.

Application of the detergent composition in a hot melt form is particularly advantageous in that the need to apply subsequent heat treatment for the purpose of driving off water of solution or the like is eliminated and increased production speed and saving in energy can therefore be achieved. Moreover acceleration of cooling of the treated substrate may be effected by passing it through a refrigerated zone thereby enabling still further increases in production speed and consequent savings to be achieved.

The non-ionic alcohol ethoxylate may be selected from natural fatty alcohol, a linear synthetic alcohol or a branched chain synthetic alcohol having 10 to 18 carbon atoms in the chain together with 10 to 30 moles of ethylene oxide. The fatty acid soap preferably comprises a saturated fatty acid having 10 to 22 carbon atoms neutralised with an organic amine or ammonia.

Figure 2:
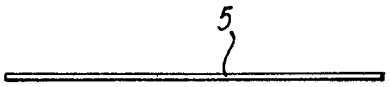

An embodiment of the invention will now be described, by way of example only, with reference to the accompanying drawings, in which:

FIG. 1 is a plan view of a personal cleaning product according to the invention; and FIG. 2 is an end view of the product shown in FIG. 1.

Referring to the drawings, there is shown a personal cleaning product designed for use during showering and comprising a sheet 5 of polyurethane foam between 6 and 10 inches long and between 5 and 8 inches wide provided with slits 6 adjacent three of its edges for engagement by the user's fingers to enable the product to be maintained in a spread or flattened condition during use.

The sheet 5 is impregnated with a detergent composition comprising a non-ionic alcohol ethoxylate and a fatty acid soap, the non-ionic alcohol ethoxylate consisting of a blend of two synthetic alcohol ethoxylates having 13 and 15 carbon atoms respectively in the chain in the ratio of 67% of the first to 33% of the second, both chemically combined with 20 moles of ethylene oxide. The fatty acid soap comprises stearic acid triethanolamine soap. The composition also incorporates between 2 and 5% by weight of a perfume composition serving to impart a perfumed odour to the product.

In production of the product a web of polyester-urethane foam 2 mm thick having a weight of 56 grammes per square meter and a density of 28 kilogrammes per cubic meter and having 18 to 22 cells per linear centimeter, was passed at a speed of 35 meters per minute through nip-rolls serving to compress the foam so as to expel air therefrom. The nip-rolls also served as applicators to apply the detergent composition to the foam, the composition being applied at a temperature of 45° to 55° C. and preferably 50° C., and the ratio of detergent composition to foam comprising 4:1 by weight. After passing through the nip-rolls the foam was allowed to expand to its normal dimensions and was then cooled to 25° C. by forced air draught at ambient temperature. The foam was then cut into sections of the desired size and provided with the slits 6 to enable its use as a personal cleaning product in the manner previously described.

A particular advantage of the detergent composition utilised is its ability to lather in both hot and cold water. This enables the product to be used in conjunction with either hot or cold showers without loss of lathering efficiency. Provision of the slits or other openings for engagement by the user's fingers prevent the product from rolling up during use and because of the thin nature of the substrate the product can be produced relatively cheaply and may be discarded after use. The invention therefore provides a personal cleaning product which is of relatively inexpensive construction so that it may be used once and then discarded.

Various modifications may be made without departing from the invention. For example, while polyurethane foam is preferred as the substrate, other substrates having an open celled foam structure may be used. Other means of impregnating the detergent composition into the substrate may be employed and the resultant product may contain a number of openings of slit or other form to enable it to be maintained in a flat condition during use. The thickness and construction of the foam and the nature of the detergent composition may also be varied.

We claim:

1. A disposable personal cleaning product comprising a substrate consisting of a sheet of open celled foam structure from 1–5 mm thick having dispersed throughout its cross-section a detergent composition comprising a non-ionic alcohol ethoxylate and a fatty acid soap.

2. A product according to claim 1 wherein the ratio of detergent composition to substrate is between 2:1 and 10:1 by weight.

3. A product according to claim 2 wherein the ratio of detergent composition to substrate is approximately 4:1 by weight.

4. A product according to claim 2 wherein the detergent composition comprises 90–10% by weight of a non-ionic alcohol ethoxylate and 10–90% by weight of a fatty acid soap.

5. A product according to claim 1, 2 or 4 wherein the non-ionic alcohol ethoxylate is selected from natural fatty alcohols, linear synthetic alcohols and branched chain synthetic alcohols having 10 to 18 carbon atoms in the chain together with 10–30 moles of ethylene oxide.

6. A product according to claim 1, 2 or 4 wherein the non-ionic alcohol ethoxylate comprises a blend of two synthetic alcohol ethoxylates having 13 and 15 carbon atoms respectively in the chain in the ratio of 67% of the first to 33% of the second, both blended with 20 moles of ethylene oxide.

7. A product according to claim 1, 2 or 4 wherein the fatty acid soap comprises a saturated fatty acid having 10 to 22 carbon atoms neutralised with an organic amine or ammonia.

8. A product according to claim 7 wherein the fatty acid soap comprises stearic acid ethanolamine.

9. A product according to claim 1, 2 or 4 including 2–5% by weight of a perfume composition.

10. A product according to claim 1, 2 or 4 wherein said open-celled foam structure comprises polyurethane foam.

11. A product according to claim 10 wherein said foam structure comprises polyester-urethane foam.

12. A product according to claim 10 wherein said foam has 18 to 22 cells per linear centimeter.

13. A product according to claim 1, 2 or 4 wherein said substrate is provided with through openings disposed at and confined to peripheral regions thereof, said openings being positioned for ready engagement by a user's fingers to enable the product to be maintained in an open or spread condition during use, and the remaining surface area of said substrate being unbroken.

14. A product according to claim 13 wherein said openings comprise slits.

15. A product according to claim 13 which is of generally rectangular shape and wherein three such openings are provided adjacent three of the four edges of the product.

16. A disposable personal cleaning product comprising a substrate consisting of a sheet of open celled polyurethane foam from 1–5 mm thick having dispersed throughout its cross-section a detergent composition comprising 90–10% by weight of a non-ionic alcohol ethoxylate and 10–90% by weight of a fatty acid soap, the ratio of detergent composition to substrate being between 2:1 and 10:1 by weight.

17. A product according to claim 16 wherein said substrate is provided with through openings which may be engaged by a user's fingers to enable the product to be maintained in an open or spread condition during use.

18. A personal cleaning product comprising an open celled substrate of thin sheet-like form provided with through openings disposed at and confined to peripheral regions thereof, said openings being positioned for ready engagement by a user's fingers to enable the product to be maintained in an open or spread condition during use, and the remaining surface area of said substrate being unbroken.

19. A method of producing a disposable personal cleaning product comprising impregnating a continuously moving sheet of open-celled foam from 1–5 mm thick with a detergent composition comprising a non-ionic alcohol ethoxylate and a fatty acid soap in a melted condition by compressing the foam sheet, applying the melted detergent composition, and allowing the sheet to expand to draw the composition into and disperse it throughout the cross-section of the foam structure.

20. A method according to claim 19 wherein the foam structure comprises polyester-urethane foam having 18 to 22 cells per linear centimeter.

21. A method according to claim 19 or 20 wherein the melted detergent composition is applied to the compressed sheet at a temperature of 45°–55° C. and after expansion the sheet is cooled to around 25° C.

22. A method according to any of claims 19 or 20 wherein the ratio of detergent composition to substrate is between 2:1 and 10:1.

23. A method according to any of claims 19 or 20 wherein the ratio of detergent composition to substrate is of the order of 4:1.

24. A method according to any of claims 19 or 20 wherein said detergent composition comprises 90–10% by weight of non-ionic alcohol ethoxylate and 10–90% by weight of fatty acid soap.

25. A method according to any of claims 19 or 20 wherein the impregnated sheet is cut into sections of desired size and provided with through openings which may be engaged by a user's fingers to enable the product to be maintained in an open or spread condition during use.

26. A method according to claim 25 wherein said openings comprise slits.

* * * * *